US005141098A

United States Patent [19]

Schmale

[11] Patent Number: 5,141,098

[45] Date of Patent: Aug. 25, 1992

[54] HANDLING WEB WORKPIECES

[75] Inventor: Carl Schmale, Ochtrup, Fed. Rep. of Germany

[73] Assignee: Carl Schmale GmbH & Co. KG, Ochtrup, Fed. Rep. of Germany

[21] Appl. No.: 685,839

[22] Filed: Apr. 15, 1991

[30] Foreign Application Priority Data

Apr. 14, 1990 [DE] Fed. Rep. of Germany ... 9004327[U]

[51] Int. Cl.[5] ..... B65G 37/00

[52] U.S. Cl. ..... 198/468.6; 271/175; 198/468.2

[58] Field of Search ..... 198/644, 468.01, 468.2, 198/468.6, 470.1; 112/121.15, 121.29, 262.1, 262.3; 271/3, 6, 7, 69, 85, 184, 185, 186, 198, 225

[56] References Cited

U.S. PATENT DOCUMENTS

| | | | |
|---|---|---|---|
| 3,483,802 | 12/1969 | Heyne | 198/470.1 X |
| 3,672,313 | 6/1972 | Firestein et al. | 271/69 X |
| 4,399,991 | 8/1983 | Everall, Jr. et al. | 271/175 |
| 4,615,288 | 10/1986 | Matsuda | 271/85 X |
| 4,729,555 | 3/1988 | Brocklehurst | 271/175 |
| 4,954,045 | 9/1990 | Gazzarrini | 271/175 X |

FOREIGN PATENT DOCUMENTS

| | | | |
|---|---|---|---|
| 0150918 | 7/1986 | Japan | 198/468.6 |
| 0171759 | 7/1988 | Japan | 271/85 |

*Primary Examiner*—Robert P. Olszewski
*Assistant Examiner*—James R. Bidwell
*Attorney, Agent, or Firm*—Herbert Dubno; Andrew Wilford

[57] ABSTRACT

A succession of web workpieces are first positioned at a loading station one after the other flat on an upstream input conveyor and then are transported by the conveyor in a transport direction through a treatment station where the workpieces are acted upon to a downstream output table. The workpieces are then gripped one at a time, and then lifted off the output table and displaced laterally of the transport direction to a return conveyor extending in the transport direction. These workpieces are then moved by the return conveyor opposite the transport direction to the loading station.

15 Claims, 3 Drawing Sheets

4
13
24
18
20
12
11
5
10
8
3
9
1
9

HANDLING WEB WORKPIECES

FIELD OF THE INVENTION

The present invention relates to a method of and apparatus for handling web workpieces. More particularly this invention concerns the edge stitching or finishing of textile workpieces.

BACKGROUND OF THE INVENTION

In the manufacture of web, normally textile, articles it is standard to have to lay out the articles one at a time on an input table, pass them through a treatment station, and then pick them up off an output table on the other side of the station. For instance in the manufacture of hand towels a worker positions an edge to be stitched along an edge of the input table so that conveyor belts built into this table can move the workpiece through an edge seamer that forms, for instance, a chain-stitch selvedge. Then another worker takes the finished towels off the downstream output table and, if necessary, transports them back upstream so that the opposite edges can be similarly stitched.

Operating such a machine requires a skilled worker. The workpieces must be exactly positioned s that unless the worker is very capable, the machine will have to operate relatively slowly.

OBJECTS OF THE INVENTION

It is therefore an object of the present invention to provide an improved system for handling web workpieces.

Another object is the provision of such an improved system for handling web workpieces which overcomes the above-given disadvantages, that is which largely automates the operations described above.

SUMMARY OF THE INVENTION

A succession of web workpieces according to the invention are first positioned at a loading station one after the other flat on an upstream input conveyor and then are transported by the conveyor in a transport direction through a treatment station where the workpieces are acted upon to a downstream output table. The workpieces are then gripped one at a time, and then lifted off the output table and displaced laterally of the transport direction to a return conveyor extending in the transport direction. These workpieces are then moved by the return conveyor opposite the transport direction to the loading station.

With this system it is possible for a worker standing in one place to see to the finishing of both ends of a workpiece. Everything but the positioning of the workpiece for stitching is completely automatic, so that a high production rate is possible. Indeed, it is possible to achieve output that is three times what has normally been considered good.

According to a further feature of this invention the workpieces are gripped by having a fold formed in them and having the fold pushed between the jaws of a gripper. This fold is formed immediately adjacent the stitched edge of the workpieces.

The apparatus of this invention thus has input and output tables flanking the treatment location and both formed as conveyors. The gripper itself is carried on a carriage that can ride the full length of a beam extending transversely of the direction above the output station and return conveyor. This beam extends at an obtuse angle to the direction that is determined by the transport speed of the workpieces, the faster they move the more obtuse it is. The carriage is attached to one reach of a chain extending along the beam and engaged over a pair of sheaves at ends of the beam.

The workpieces are engaged in the gripper by means of a bar raisable from underneath the output table. In addition the gripper can be vertically movable to engage and grasp the workpieces. The gripper and bar are positioned immediately adjacent the front edge, which is the edge remote from the return conveyor and extending in the transport direction, of the workpieces.

In accordance with further features of this invention the workpieces are gripped as they move through and past the stitcher by a pair of gripping belts extending in the direction and engageable to opposite vertical sides of the workpieces. One of these belts can be vertically movable or pivotal to release the workpieces.

The return carriage according to the invention extends back upstream past the input table to a worker station upstream of the input table. A deflector, for instance a roller extending in the transport direction is provided between the output table and the return conveyor.

The gripper itself includes a pair of transversely relatively movable bars both extending in the transport direction. The drive for the gripper displaces it through a transverse stroke and displaces the gripper substantially more rapidly in a central region of this stroke than at end regions thereof.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
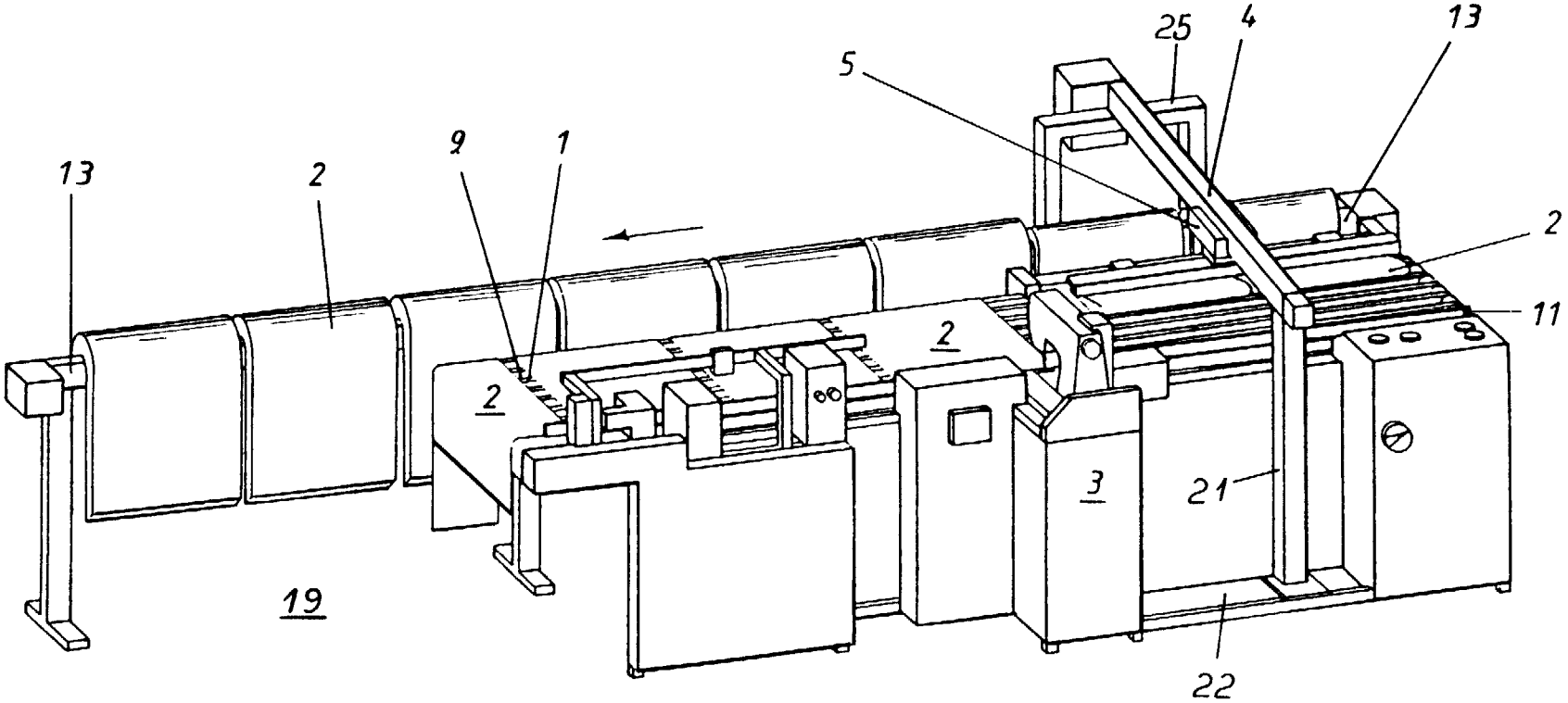
FIG. 1 is a perspective view of a machine for carrying out the method of this invention.

As seen in FIG. 1 a machine for handling workpieces 2, here for stitching the ends of pieces of terry cloth cut for towels, has an input table 1 situated adjacent a loading station 19 where a worker stands. The table 1 is formed of conveyor belts 9 movable in a transport direction 8 past an edge-stitcher 3 and having downstream ends spanned over rollers 10. Downstream of the table 1 is an output table 18 formed by further such conveyor belts 20 having upstream ends spanned over the rollers 10 and forming a horizontal continuation of the upstream input table 1. Upper and lower edge-gripping belts 11 are provided for advancing the front edge of the workpieces 2 through the stitcher 3.

Figure 2:
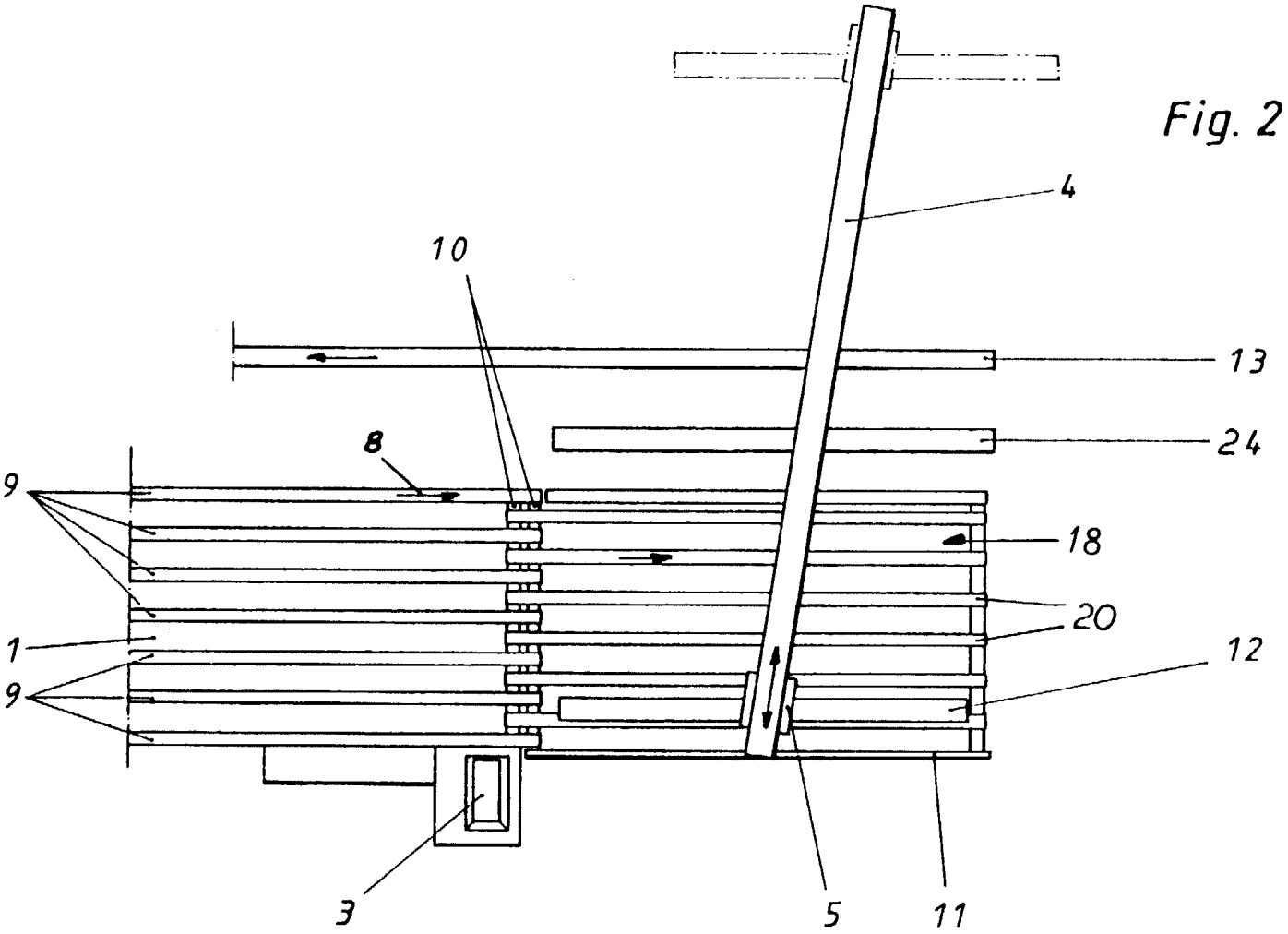
FIG. 2 is a larger-scale view of a detail of FIG. 1.
Figure 3:
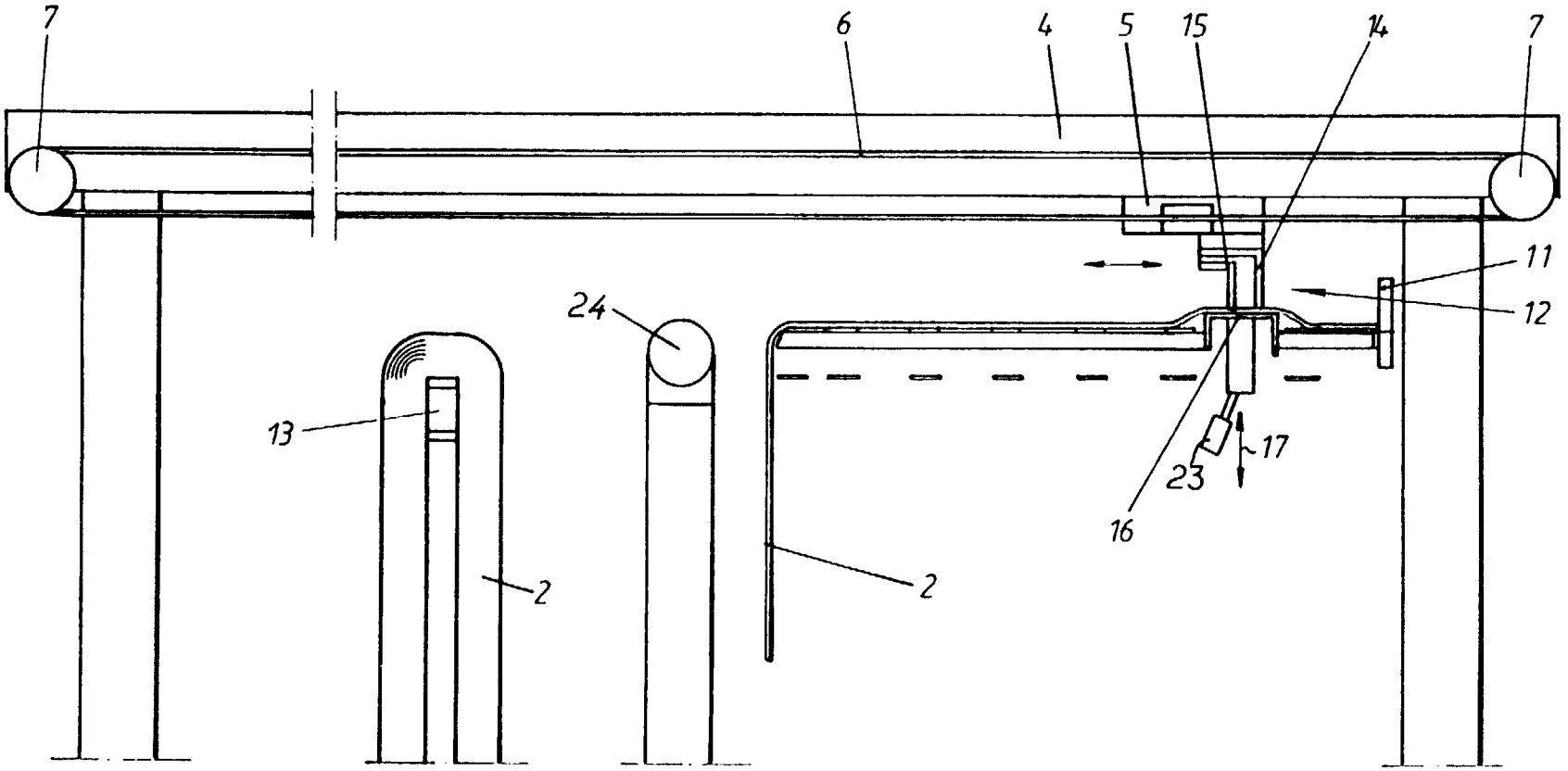
FIG. 3 is a vertical cross section through the machine.

According to this invention and as seen in FIG. 2 a horizontal guide beam 4 has its rear end pivoted about a vertical axis on a two-legged support 25 and its front end supported on a column 21 that can be moved in the transport direction 8 in a guide 22. This beam 4 is a guide rail for a carriage 5 that can move its full length and that carries as seen in FIG. 3 a gripper 12 formed of two angle irons 14 and 15 that extend parallel to each other and to the transport direction 8. Underneath the table 18 is a lifter bar 16 that can be moved by an actuator 23 as indicated by arrow 17, as can the gripper 12, to push the workpieces 2 adjacent their front-edge seam up into the gripper 12. The beam 4 houses a chain 6 spanned at its end over sheaves 7 and connected to the carriage 5 to move it back and forth along the beam 4.

Extending the full length of the rear side of the machine is a return conveyor 13 formed as a simple chain on whose upper stretch the workpieces 2 can be stacked. Between the output table 18 and the conveyor 13 is a roller 24 over which the workpieces 2 can be pulled when being moved from the table 18 to the return conveyor 13.

Thus according to the invention a workpiece 2 is laid by a worker standing in the station 19 on the input table 1 so that its front edge is caught in the two belts 11. It is then pulled through the stitcher 3 where this front edge is over-stitched to finish it and prevent it from raveling.

From the stitcher 3 each workpiece 2 then is moved by the conveyors 9 and 20 to the output table 18. The lifter bar 16 is raised to push a fold of the stitched workpiece 2 between the jaws 14 and 15 of the gripper 12 which have been lowered to receive it, and the movable jaw 15 slides over to grip this fold, and then the carriage 5 is shifted back along the guide beam 4. This pulls the workpiece 2 off the table and over the roller 24 to deposit it on the return conveyor 13. This action reverses the orientation of the front and rear edges of each workpiece.

Once a stack of 10 to 20 such workpieces 2 is built, the conveyor 13 is stepped against the direction 8 to shift the stack back upstream. Thus the worker at the station 19 can put these workpieces 2 back on the table 1 to feed their unstitched other ends to the stitcher 3, finishing them.

The angle the beam 4 forms with the direction 8 is dependent on the speed at which the workpieces 2 move. The new workpiece coming from the stitcher 3 is moving at full speed while the preceding workpiece has stopped. In addition the carriage is moved slowly at the two ends of its stroke, but is moved relatively quickly between these two end portions.

1 claim:

1. A method of treating a succession of web workpieces, the method comprising the steps of:

positioning the workpieces at a loading station one after the other flat on an upstream input conveyor;

transporting the workpieces one at a time with the conveyor in a transport direction parallel to front and rear edges of the workpieces through a treatment station where the front edges of the workpieces are acted upon to a downstream output table;

forming a fold adjacent the front edge of each of the workpieces when same arrive on the output table;

gripping the folds of the workpieces one at a time, lifting them off the output table, and displacing them laterally of the transport direction in a transverse direction forming an obtuse angle with the transport direction to a return conveyor extending in the transport direction; and transporting the workpieces with the return conveyor opposite the transport direction to the loading station.

2. The web-treating method defined in claim 1 wherein the workpieces are gripped by having their folds pushed between the jaws of a gripper.

3. The web-treating method defined in claim 1 wherein the workpieces are acted upon by having their front edges stitched.

4. The web-treating method defined in claim 1 wherein as the gripper displaces the workpieces off the output table it reverses the orientation of their front and rear edges.

5. An apparatus for treating a succession of web workpieces, the apparatus comprising:

an input table provided with means for conveying the workpieces through a treatment station in a transport direction parallel to front and rear edges of the workpieces;

an output table downstream in the direction from the input table and treatment station and forming a continuation of the input table;

means at the treatment station for acting on the front edges of the workpieces;

means including a gripper displaceable transversely of the transport direction above the output station in a direction forming an obtuse angle with the transport direction;

means for forming in each workpiece on the output table adjacent the respective front edge a fold and for engaging the folds one after the other in the gripper;

drive means for actuating the gripper and moving same with a workpiece fold gripped thereby transversely of the transport direction at the obtuse angle to the transport direction off the output table; and a return conveyor extending from adjacent the output table to adjacent the input table for receiving workpieces from the gripper and including transport means for displacing the received workpieces back upstream opposite the transport direction.

6. The web-treating apparatus defined in claim 5 wherein the means for forming and engaging the folds in the gripper includes a bar raisable from underneath the output table.

7. The web-treating apparatus defined in claim 5 wherein the gripper is vertically movable to engage and grasp the workpieces.

8. The web-treating apparatus defined in claim 5 wherein the means at the treatment station includes a stitcher engageable with the front edges of the workpieces.

9. The web-treating apparatus defined in claim 5, further comprising:

a beam extending transversely of the transport direction and at the obtuse angle thereto above the output station and return conveyor; and a carriage displaceable the full length of the beam and carrying the gripper.

10. The web-treating apparatus defined in claim 9 wherein the drive means includes a chain extending along the beam; and a pair of sheaves at ends of the beam over which the chain is engaged, the chain having a stretch connected to the carriage.

11. The web-treating apparatus defined in claim 5, further comprising a pair of gripping belts extending in the direction and engageable to opposite sides of the workpieces to hold same.

12. The web-treating apparatus defined in claim 5 wherein the return conveyor extends back upstream past the input table to a worker station upstream of the input table.

13. The web-treating apparatus defined in claim 5, further comprising a deflector roller between the output table and the return conveyor.

14. The web-treating apparatus defined in claim 5 wherein the gripper includes a pair of transversely relatively movable bars both extending in the transport direction.

15. The web-treating apparatus defined in claim 5 wherein the drive means displaces the gripper through a transverse stroke and displaces the gripper substantially more rapidly in a central region of this stroke than at end regions thereof.

* * * * *